US005443671A

United States Patent [19]

Stechler

[11] Patent Number: 5,443,671

[45] Date of Patent: Aug. 22, 1995

[54] PROCESS FOR MANUFACTURING A CUSHIONED EYEGLASS CASE

[76] Inventor: Bernard G. Stechler, 36-20 34th St., Long Island, N.Y. 11106

[21] Appl. No.: 186,122

[22] Filed: Jan. 25, 1994

Related U.S. Application Data

[62] Division of Ser. No. 979,335, Nov. 20, 1992, Pat. No. 5,310,048.

[51] Int. Cl.[6] ..... B32B 31/04; B32B 31/12; B32B 31/26; B32B 31/24

[52] U.S. Cl. ..... 156/226; 156/227; 156/256; 156/263; 156/275.1; 156/305; 156/308.4; D3/219

[58] Field of Search ..... 206/5, 5 R, 594, 37, 206/38, 271, 273, 349, 371, 491, 553, 822; 156/226, 227, 256, 275.1, 305, 308.4; D3/219

[56] References Cited

U.S. PATENT DOCUMENTS

| | | | |
|---|---|---|---|
| 2,087,480 | 4/1943 | Pitman . | |
| 2,650,700 | 9/1953 | Wolf | 206/5 R |
| 2,966,985 | 1/1961 | Morris | 206/5 R |
| 3,036,697 | 5/1962 | Dove | 206/5 R |
| 3,444,732 | 5/1969 | Robbins et al. . | |
| 3,545,603 | 12/1970 | Warsager | 206/5 R |
| 3,749,231 | 7/1973 | Nathan | 206/5 |
| 3,989,778 | 11/1976 | Osborne | 156/275.1 X |
| 4,267,923 | 5/1981 | Baratelli et al. | 206/5 |
| 4,338,150 | 7/1982 | Weeks | 156/275.5 |
| 5,123,525 | 6/1992 | Orlowski | 206/5 |

*Primary Examiner*—David A. Simmons
*Assistant Examiner*—M. Curtis Mayes
*Attorney, Agent, or Firm*—Sherman and Shalloway

[57] ABSTRACT

An open-end cushioned eyeglass case and method of manufacture wherein the case comprises an outer cover of heat-sealable material and a protective inner cushioning layer, the inner layer having a width and length which are each smaller than the width and length, respectively, of the outer cover. The cover and cushioning layer are assembled in overlying relationship with their top edges flush and are sealed together along those edges. The composite sheet is then folded along its longitudinal axis so that the opposed inner peripheral side and bottom edges of the outer cover are in direct contact and these edges are heat sealed together.

14 Claims, 2 Drawing Sheets

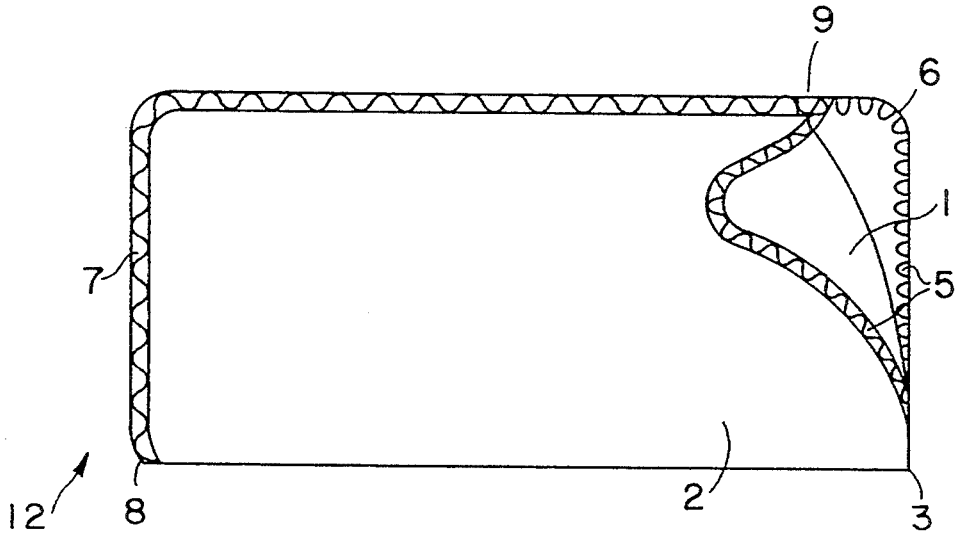
FIG. 3
FIG. 4
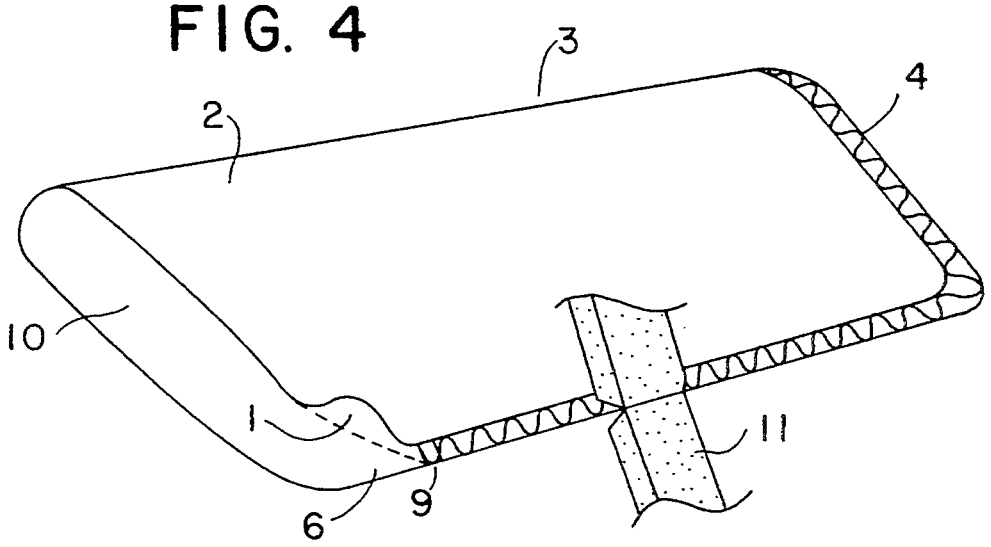

PROCESS FOR MANUFACTURING A CUSHIONED EYEGLASS CASE

This is a division of application Ser. No. 07/979,335 filed Nov. 20, 1992, now U.S. Pat. No. 5,310,048 issued May 10, 1994.

BACKGROUND OF THE INVENTION

1. Field of the Invention

This invention relates to eyeglass cases having a cushioning lining and to the method of manufacture thereof. More specifically, the invention relates to such eyeglass cases in which a reinforced bar tear seal (BTS) is used to adhere the edges of the eyeglass case together.

2. Description of the Prior Art

The most common types of "open end" construction for eyeglass cases involve a sewing process to bind the perimeter of the case together. This type of construction is particularly useful in the manufacture of eyeglass cases comprising a laminate having a PVC outer layer and an inner layer of soft cushioning material, which layers are sewn together when they are assembled and folded in half longitudinally.

Huber, U.S. Pat. No. 3,819,033, discloses an eyeglass case comprising an inner lining of elastic material surrounded by an outer covering. The edges of the walls are stitched or otherwise secured together. Jacobsen, U.S. Pat. No. 3,559,798, discloses an eyeglass case made from a flexible and stretchable closed cell elastomeric material, which is bonded to an outer skin of stretchable fabric. The folded edges are secured by cementing with glue or adhesive, or by stitching. However, one of the problems associated with the process of Huber or Jacobsen is that the product is inherently weak at the seams and thus not as durable as everyday use requires.

Baratelli, et al., U.S. Pat. No. 4,267,923, disclose an eyeglass case formed by folding a sheet of plastic material longitudinally and securing the edges along two sides by stitching or heat sealing. The case does not have a flock type or other cushioning lining, but consists only of a single layer of a suitable plastic material. Consequently, such a construction provides inadequate protection of the lenses from scratching.

Attempts to introduce a lining layer into the eyeglass case with electronically heat sealed edges were unsuccessful due to the inability of the lining layer to be fused or heat sealed to itself or to the plastic cover. After extensive research and numerous trials the present inventors discovered that by slightly reducing the size of the cushioning liner layer relative to the outer plastic casing material, the plastic sheet could be folded over upon itself with sufficient width of heat sealable plastic around the bottom edge and side wall edges to allow the composite outer casing and cushioning liner to be heat-sealed by fusing the uncovered and contacting edges of the outer plastic layer of heat sealable polyvinyl chloride. However, still further considerable research and experimentation was required in order to develop a process for releasably and uniformly electronically heat-sealing the contacting heat sealable edges without interference by the relatively thick inner cushioning layer.

It is, therefore, an object of this invention to provide an open end type eyeglass case having a heat sealable plastic outer layer bonded to a soft cushioning inner layer in which the edges of the outer layer are electronically heat-sealed to form a reinforced bar tear seal.

It is another object of the present invention to provide a method of manufacturing a thin film open end eyeglass case having a cushioning lining.

More specifically, it is an object of this invention to provide a method of manufacturing a case of the type described using an electronic heat seal to secure the edges along the sides of the case.

BRIEF DESCRIPTION OF THE DRAWINGS

FIG. 3 is a plan view of an eyeglass case according to the invention with one open end flap bent back to facilitate an inside view of the case.

FIG. 4 is an oblique view illustrating the process of forming a heat seal between the overlapping edges of the outer layer using an electronic heat seal apparatus.

SUMMARY OF THE INVENTION

Figure 1:
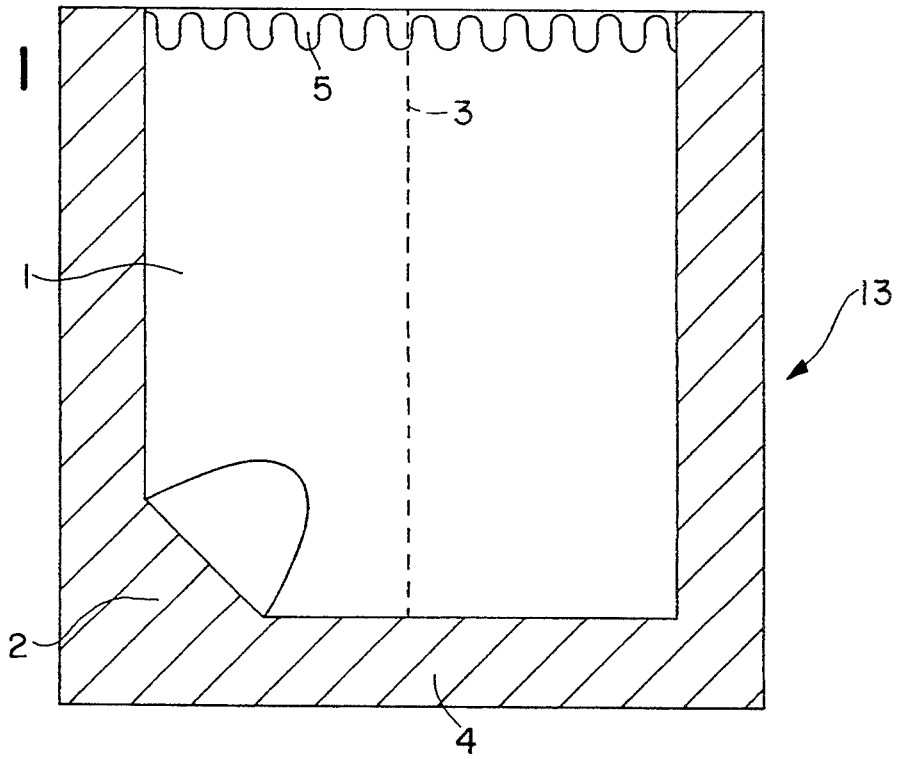
FIG. 1 is a plan view illustrating a first embodiment of a laminated pre-cut cushioning lining layer in relation to a pre-cut outer layer used to form the eyeglass case of the invention.

In one aspect, the present invention provides an open-end cushioned eyeglass case comprising an outer cover of heat-sealable polyvinyl chloride and an eyeglass protecting inner cushioning layer having a width and length which are each smaller than the width and length, respectively, of the outer cover. The cover and cushioning layer are assembled in overlying relationship with the longitudinal axes thereof being in at least substantial alignment with each other, and at least the upper edge of the cushioning layer being sealed to the inner surface the cover in proximity to the upper edge thereof forming a composite sheet assembly, the assembly being folded over upon itself along the at least substantially aligned longitudinal axes such that the opposed inner peripheral side edges of the heat-sealable polyvinyl/chloride outer cover are in direct contact with each other and the halves of the folded over inner peripheral bottom edge of the outer cover as defined by the longitudinal axis thereof are also in direct contact. The opposed inner contacting peripheral side edges and contacting bottom edge halves are electronically heat-sealed to thereby form a fused side edge opposite the folded-over side edge and a fused bottom edge opposite the upper edge which defines the open end of said eyeglass case, and wherein the cushioning layer does not interfere with the electronically heat-sealed and fused bottom and side edges.

In accordance with a preferred embodiment, the cushioning lining layer has a top part having ears extending at least substantially the full width of the upper edge of the outer layer and a reinforcing heat seal rectangular shaped spot is applied to the outer layer at the area directly below the ears of the lining layer to provide additional structural strength.

In another aspect, the present invention provides a process for manufacturing an open-end type eyeglass case in which a heat-sealable polyvinyl chloride film outer layer is secured to at least one edge of a lining layer comprising a cushioning material having a plastic coating on one side. The process incudes the steps of (1) cutting the outer layer in a substantially rectangular shape suitably dimensioned for a substantially rectangular eyeglass case and cutting the lining layer to a shape similar to but smaller than that of the outer layer, (2) superimposing the lining layer on the outer layer to form a composite sheet in which the top edge of the lining layer is substantially centered on and is flush with the top edge of the outer layer and the plastic coating of the lining layer is in contact with the inner surface of the outer layer whereby the inner surface of the polyvinyl chloride film outer layer is exposed along both side edges and the bottom edge, (3) electronically heat-sealing the outer layer and lining layer along the top edge of the composite sheet forming the open end of the eyeglass case, (4) folding the heat-sealed composite sheet over onto itself along its longitudinal axis whereby the exposed side edges of the polyvinylchloride outer layer thereof are superimposed over each other and the exposed bottom edge is folded over on itself, and (5) electronically heat-sealing the superimposed side and bottom edges of the outer layer to form a bar tear seal on the side and bottom edges. Alternatively, the sealing of the top edges of the lining layer and the outer layer may be accomplished at the same time as the superimposed side and bottom edges are sealed. In this embodiment the lining layer and the outer layer will be cut and superimposed as in steps (1) and (2) and supported in a holding means which permits the layers to be folded and sealed in one step. Accordingly, following step (2), the superimposed layers will be folded to bring the exposed side and bottom edges of the outer layer together. At this point the aligned top edges of the lining layer and the outer layer will be electronically heat sealed while simultaneously the superimposed side and bottom edges of the outer layer will be electronically heat sealed. In this manner, the step of separately sealing the two layers is eliminated.

In accordance with a preferred embodiment, the lining layer has a top edge having ears which extend to the full width of the outer layer and a reinforced heat seal spot is formed on the superimposed side edges of the outer layer at the area directly below the ears of the lining layer of the formed case.

Several advantageous features are provided by the process and eyeglass case of the present invention. The present invention is very simple in design and requires a shorter production time than conventional processes, such as sewing, to bind the edges. The process of the present invention provides a substantially stronger and more durable eyeglass case having a protective, cushioning lining than conventional processes involving sewing, especially single stitch sewing, or cementing the edges of a case. Moreover, the present invention results in a significant reduction of production time and does not appreciably add to and, in fact, may even reduce the cost of the case.

Further advantages and features of this invention will become apparent hereinafter in conjunction with the accompanying figures and following detailed description.

DETAILED DESCRIPTION OF THE INVENTION

FIGS. 1 through 4 illustrate an eyeglass case in accordance with a preferred embodiment of the invention and a process of forming a case for holding a pair of eyeglasses (lenses and frame) of different size and/or shape. The case is identified by reference number 12 and the case illustrated in FIGS. 3 and 4 is of a style generally referred to as an open end case, in that a pair of eyeglasses is inserted into and removed from the case through an opening 10.

Figure 2:
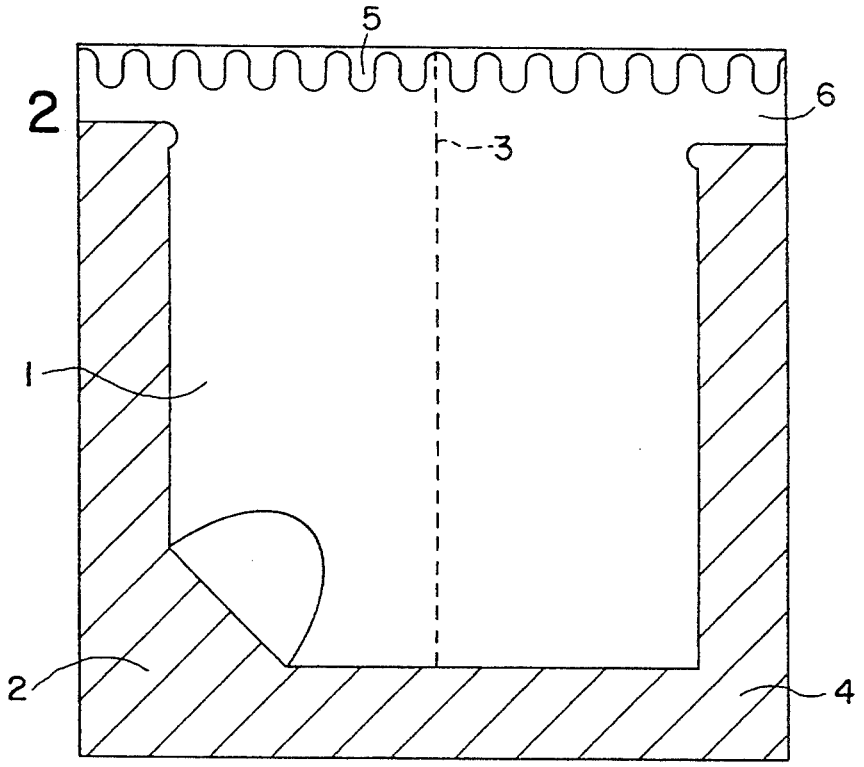
FIG. 2 is a plan view illustrating a second embodiment of a laminated pre-cut cushioning lining layer in relation to a pre-cut outer layer used to form the eyeglass case of the invention.

FIGS. 1 and 2 illustrate two embodiments of the laminated layers of materials from which the case is made. The cushioning liner layer 1 can be die cut, for example, to a substantially square or rectangular shape, from a sheet of flocked material having a polymer coating on one side. Such cushioning lining materials are commercially available. Alternatively, separate layers of flocked material and heat sealable polymer can be laminated to each other by suitable contact adhesive either before or after being die cut. Similarly, the outer layer 2 can be die cut from a sheet of polymer (PVC) film to a size and shape similar to that of the polymer-backed flock material, only larger, as illustrated in FIG. 1. Alternatively, the outer layer 2 may be die cut to a substantially square (as illustrated) or rectangular shape and the cushioning liner layer 1 may be cut smaller than the outer layer and having ears 6 extending on either side of the top edge. The layers 1 and 2 are assembled such that the liner layer 1 is centered and superimposed on the outer layer 2 with the top edges of the layers flush and the polymer coated side of the liner layer 1 in contact with the inner surface of the outer layer 2. The exposed area 4 of the laminated sheet beyond the area of the liner layer may be in the range of $\frac{1}{8}''$ to $\frac{1}{2}''$ wide, depending on the thickness of the laminated sheet. Preferably, the width of the exposed area 4 is in the range of $\frac{1}{4}''$ to $\frac{1}{2}''$.

The liner 1 and outer 2 layers of the assembled sheets are joined at the top edge by heat sealing. Preferably this forms a bar tear seal 5 extending the full length of the top edge and around the ends of ears 6 when they are present although other types of seals maybe formed. This seal serves to hold the liner layer firmly in place during further manipulation of the resulting laminated assembled sheet. Alternatively, this sealing step may be postponed until the assembled sheets are folded and edge sealed to form the case.

Liner layer 1 is preferably constructed of a flocked material having a polymer coating on one side thereof, or from separate laminated flocked material and heat sealable polymer film. The coated or laminated flocked material should have the characteristics of flexibility, relatively high tensile strength, cushioning or shock absorbancy, and resistance to tearing. Any one of a number of flocked materials usually used for protective eyeglass cases may be used in this invention. It has been found, for example, that brushed nylon, foam tricho and expanded brushed anti-static nylon will provide satisfactory cushioning. One side of the flocked material is coated or laminated to a thin polymer film to allow bonding of the pre-cut liner layer 1 to the pre-cut outer layer 2. The polymer is selected from ethylene, propylene and vinyl chloride polymers or copolymers and should be sealably compatible with the polymer material from which the outer layer 2 is formed. Polyvinyl chloride is preferred and may be unsupported expanded PVC. The flocked material may comprise a three-layer laminate of a polymer layer, a foam layer of desired thickness and a layer of flocked material.

The outer layer 2 is formed from a thin, heat sealable polymer film, such as, ethylene, propylene or vinyl chloride polymers or copolymers, and is preferably a vinyl chloride polymer film such as unsupported expanded PVC. The vinyl chloride polymer may be a homopolymer or a copolymer with one or more other copolymerizable monomers such as, for example, ethylene and propylene. Preferably, 8 to 20 gauge polyvinyl chloride film is used as the outer layer 2, however, the thickness can vary usually from 5 to 80 gauge, the thicker materials resulting in a stiffer or more rigid case. This layer additionally may be colored or transparent and may be embossed or in other ways decorated so as, for example, to have the look and feel of leather.

The case 12 is prepared by folding the assembled laminated sheet along a central longitudinal axis 3 over onto itself such that the exposed areas 4 of the outer layer 2 are superimposed and flush and the lining layer 1 is innermost. The exposed areas 4 of the outer layer 2 are joined by heat sealing to form an "L-shaped" seal 7 along that portion of the perimeter of the case corresponding to the now superimposed and flush edges. Preferably seal 7 is of the type known as a bar tear seal, although other types of heat seals may be formed such as a simple bar seal. For materials which are not well suited to direct heat sealing or RF sealing, a heat activated adhesive may be applied to the exposed areas 4 and used to seal the edges of the case. If lining layer 1 and outer layer 2 have not previously been joined at their top edges, they may be so sealed simultaneously with the joining of the exposed areas 4 of outer layer 2. It should be noted that the sealing together of the top edges of lining layer 1 and outer layer 2 at this time is conducted in a manner to preserve the top opening of the case; that is, the folded over top edges of lining layer 1 are not sealed to each other.

The seal along the perimeter 7 of the case is made substantially uniformly along the edges of the case except at the folded corner of the lower edge where the seal is preferably made in an upward circular arc shape 8. As shown in FIG. 3, the seal does not form a point at the folded corner, but curves upward to form the arc shaped seal 8. The arc of the curve can be set to a predetermined angle depending on the thickness of the layers to be joined or the desired strength of the seal. This upward curve provides a more finished appearance to the lower corner.

The perimeter seal 7 may be reinforced at a region just below the ears of the lining layer or at the top seamside corner by a heat sealed spot 9 which is applied in addition to the seal 7. Spot 9 may be formed in a separate step or simultaneously with the formation of seal 7.

Electronic heat sealing for example, can be used to form the seals 5 and 7 and the reinforcing heat seal spot 9. Electronic heat sealing is accomplished by emitting a high frequency heating current through the layers of plastic material. The materials to be sealed are placed between a flat plate and sealing die, which is usually mounted on a hydraulic press to provide pressure for fusing the materials. A seal is made as the high frequency generated heat liquefies the material and pressure exerted on the material brings about a thorough fusion. The fused material is then cooled without any pressure. The sealing die may be formed with an edge to cut off excess material and form a finished edge on the case.

The polymer materials are heated to a temperature required to melt the polymer. The time required to melt and completely fuse the polymer materials depends upon the composition of the polymer coating of the inner layer 1 and outer layer 2, as well as the thickness of the layers. In general, thinner materials require less sealing time than thicker materials. Usually a heating time of 2 to 14 seconds, preferably 4 to 8 seconds, is required.

The amount of pressure exerted by the die on the plastic material also effects the quality of the seal. In general, a low pressure results in a less secure seal than higher pressure. However, high pressure may cause thinning of the seal and objectionable extrusions at the edge of the seal. The amount of pressure applied, therefore, is to be determined by the practitioner and is dependent upon the composition and thickness of the materials to be sealed. In general, however, constant pressures should be in the range of 90 to 120 Psi, preferably 90 to 100 psi. The specific pressure used will be dependent on the thickness and type of polymer.

As previously noted, a number of different materials may be successfully utilized in fabrication of the eyeglass case of this invention. By way of example, one case was fabricated utilizing a liner layer made from a brushed nylon lining (10″×12″) having a thickness of 20–50 Gauge laminated to a thin polyvinyl chloride backing layer and a polyvinyl chloride outer layer (11″×13″) having a thickness of 9–20 Gauge. The precut inner layer having ears of $\frac{5}{8}$″ diameter at the top edge was bonded along its top edge between the opposed ears to the larger polyvinyl chloride outer layer by heat sealing means so that the longitudinal axes of each layer were superimposed. The resulting assembly was then folded over upon itself as described and bar tear seals were formed using an electronic heat seal device such as that sold under the name Thermotron by the Thermotron Company wherein a frequency of 27 MHz and a pressure of 100 psi were applied for 20 seconds. The reinforced spot was formed below the ears by an appropriate zone on the seal forming die. The resulting case was found to afford ample protection for eyeglasses.

It will be readily apparent to those skilled in the art that other embodiments may be conceived and fabricated without departing from the scope of the specification and drawings and the invention should be limited only insofar as required by the scope of the following claims.

What is claimed is:

1. A process for manufacturing an open end type case comprising a heat sealable polyvinyl chloride film outer layer secured to at least one edge of a lining layer comprising a cushioning material having a plastic coating on one side, said process comprising the steps of:

(1) cutting the outer layer into a shape suitably dimensioned for a substantially rectangular case and cutting the lining layer to a substantially rectangular shape similar to but smaller than that of the outer layer said lining layer having a top part having identical ears on both sides which extend the top part of the lining layer to a width corresponding to the width of the outer layer, (2) superimposing the lining layer on the outer layer to form a composite sheet in which the top edge of the lining layer is substantially centered on and is flush with the top edge of the outer layer and the plastic coating of the lining layer is in contact with the inner surface of the outer layer whereby the inner surface of the polyvinyl chloride film outer layer is exposed along both side edges and the bottom edge, (3) folding the composite sheet over onto itself along its longitudinal axis whereby the exposed side edges of the polyvinyl chloride outer layer thereof are superimposed over each other and the exposed bottom edge is folded over on itself, and (4) heat-sealing the superimposed side and bottom edges of the outer layer and simultaneously heat-sealing the outer layer to the lining layer along the top edge of the composite sheet to form the open end of the case.

2. The process of claim 1, wherein the heat-sealing of the superimposed side and bottom edges of the outer layer and the heat sealing of the outer layer to the lining layer along the top edge is accomplished by electronic heat-sealing to produce a bar tear seal.

3. The process of claim 1, wherein a reinforcing heat seal spot is formed at an area directly below the ears of the lining layer.

4. The process of claim 1, wherein the heat sealing is effected by means of a heat activated adhesive applied between the outer layer and the lining layer along the top edge of the composite sheet and between the superimposed side and bottom edges of the outer layer.

5. The process of claim 1, wherein heat sealing is effected by radio frequency means.

6. A process for manufacturing an open end type case comprising a heat sealable polyvinyl chloride film outer layer secured to at least one edge of a lining layer comprising a cushioning material having a plastic coating on one side, said process comprising the steps of (1) cutting the outer layer into a shape suitably dimensioned for a substantially rectangular case and cutting the lining layer to a substantially rectangular shape similar to but smaller than that of the outer layer, said lining layer having a top part having identical ears on both sides which extend the top part of the lining layer to a width corresponding to the width of the outer layer, (2) superimposing the lining layer on the outer layer to form a composite sheet in which the top edge of the lining layer is substantially centered on and is flush with the top edge of the outer layer and the plastic coating of the lining layer is in contact with the inner surface of the outer layer whereby the inner surface of the polyvinyl chloride film outer layer is exposed along both side edges and the bottom edge, (3) heat-sealing the outer layer and lining layer along the top edge of the composite sheet forming the open end of the eyeglass case, (4) folding the heat-sealed composite sheet over onto itself along its longitudinal axis whereby the exposed side edges of the polyvinylchloride outer layer thereof are superimposed over each other and the exposed bottom edge is folded over on itself, and (5) heat-sealing the superimposed side and bottom edges of the outer layer to form a bar tear seal on said side and bottom edges.

7. The process of claim 6, wherein the outer layer and lining layer are cut to substantially rectangular shapes having rounded corners.

8. The process of claim 6, wherein a bar tear seal is formed between the top edge of the outer layer and lining layer and between the side and bottom edges of the outer layer by electronically heat sealing for a time and temperature to cause melting and fusion of the layers.

9. The process of claim 6, wherein the layers are electronically heat sealed for a period of time ranging from 2 to 14 seconds.

10. The process of claim 6, wherein the layers are electronically heat sealed under a pressure ranging from 90 to 120 psi.

11. The process of claim 6, wherein a reinforcing heat seal spot is formed at an area directly below the ears of the lining layer.

12. The process of claim 6, wherein the bottom folded corner is sealed to a circular arc shape.

13. The process of claim 6, wherein the heat sealing is effected by means of a heat activated adhesive applied between the outer layer and the lining layer along the top edge of the composite sheet and between the superimposed side and bottom edges of the outer layer.

14. The process of claim 6, wherein heat sealing is effected by radio frequency means.

* * * * *